US011435131B2

(12) United States Patent
Park et al.

(10) Patent No.: US 11,435,131 B2
(45) Date of Patent: Sep. 6, 2022

(54) HINGE ASSEMBLY AND REFRIGERATOR COMPRISING THE SAME

(71) Applicant: Samsung Electronics Co., Ltd., Suwon-si (KR)

(72) Inventors: Jaemin Park, Suwon-si (KR); Yongsoo Kyong, Suwon-si (KR); Youngkyun Jeong, Suwon-si (KR); Hyungkwen Ham, Suwon-si (KR); Wangi Park, Suwon-si (KR); Junwon Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/170,110

(22) Filed: Feb. 8, 2021

(65) Prior Publication Data

US 2021/0247129 A1 Aug. 12, 2021

(30) Foreign Application Priority Data

Feb. 10, 2020 (KR) ..... 10-2020-0015717

(51) Int. Cl.
*F25D 23/02* (2006.01)
*E05D 7/04* (2006.01)

(52) U.S. Cl.
CPC ..... *F25D 23/028* (2013.01); *E05D 7/04* (2013.01); *F25D 23/025* (2013.01);
(Continued)

(58) Field of Classification Search
CPC ..... F25D 23/028; F25D 2323/024; Y10T 16/53247; E05Y 2900/31; E05D 7/04; E05D 2007/0469
See application file for complete search history.

(56) References Cited

U.S. PATENT DOCUMENTS 4,774,740 A * 10/1988 Gidseg ..... E05D 11/1078 16/344
5,369,842 A * 12/1994 Beatty ..... E05F 1/063 16/317

(Continued)

FOREIGN PATENT DOCUMENTS

JP 3937271 6/2007
KR 10-0392797 11/2003

(Continued)

OTHER PUBLICATIONS

Written Opinion of the International Searching Authority for PCT/KR2021/001701 dated Apr. 20, 2021.

(Continued)

*Primary Examiner* — Matthew W Ing
(74) *Attorney, Agent, or Firm* — Staas & Halsey LLP

(57) ABSTRACT

A hinge assembly connecting a door of a refrigerator with a main body of a refrigerator is disclosed. The hinge assembly includes a bracket configured so that a one surface is arranged at a lower part of the door, a shaft located on the bracket and configured to be a rotational shaft of the door, and a support member rotatably arranged inserted to the shaft, and configured to support the door, and a height of a support surface supporting the door is changed according to the support member rotating based on the shaft.

19 Claims, 12 Drawing Sheets

(52) U.S. Cl.
CPC ... *E05D 2007/0469* (2013.01); *E05Y 2900/31* (2013.01); *F25D 2323/021* (2013.01); *F25D 2323/024* (2013.01)

(56) References Cited

U.S. PATENT DOCUMENTS

| | | | | |
|---|---|---|---|---|
| 7,685,678 | B2 | 3/2010 | Moon et al. | |
| 7,752,709 | B2 | 7/2010 | Moon | |
| 8,579,394 | B2 | 11/2013 | Lee | |
| 9,291,385 | B2 | 3/2016 | Hwang et al. | |
| 9,790,722 | B2 | 10/2017 | Sun | |
| 2006/0244351 | A1 | 11/2006 | Moon | |
| 2008/0201902 | A1 | 8/2008 | Moon | |
| 2009/0038117 | A1* | 2/2009 | Moon | E05D 7/081 16/240 |
| 2009/0381171 | | 2/2009 | Moon | |
| 2011/0140585 | A1 | 6/2011 | Lee | |
| 2012/0038258 | A1* | 2/2012 | Park | E05D 7/0027 312/405 |
| 2013/0067688 | A1* | 3/2013 | Kim | E05D 11/06 16/319 |
| 2014/0132141 | A1 | 5/2014 | Sun | |
| 2014/0306595 | A1 | 10/2014 | Hwang et al. | |
| 2016/0161176 | A1 | 6/2016 | Hwang et al. | |
| 2017/0167173 | A1* | 6/2017 | Johnson | E05D 11/0081 |
| 2018/0291669 | A1* | 10/2018 | Kim | F25D 23/028 |
| 2019/0003224 | A1* | 1/2019 | Reuter | E05D 7/081 |
| 2020/0308887 | A1* | 10/2020 | Raab | E05D 7/0415 |

FOREIGN PATENT DOCUMENTS

| | | | | |
|---|---|---|---|---|
| KR | 10-0610745 | | 8/2006 | |
| KR | 10-2006-0125394 | | 12/2006 | |
| KR | 10-2008-0036914 | | 4/2008 | |
| KR | 10-2011-0043046 | | 4/2011 | |
| KR | 10-2011-0068406 | | 6/2011 | |
| KR | 10-2014-0037662 | | 3/2014 | |
| KR | 10-2014-0062599 | | 5/2014 | |
| KR | 10-2014-0123291 | | 10/2014 | |
| KR | 10-2015-0000102 | | 1/2015 | |
| WO | 2008/050988 | A1 | 5/2008 | |
| WO | WO-2019150187 | A1 * | 8/2019 | E05D 3/02 |

OTHER PUBLICATIONS

International Search Report for PCT/KR2021/001701 dated Apr. 20, 2021.

* cited by examiner

HINGE ASSEMBLY AND REFRIGERATOR COMPRISING THE SAME

CROSS-REFERENCE TO RELATED APPLICATION

This application is based on and claims priority under 35 U.S.C. § 119 to Korean patent application number 10-2020-0015717, filed on Feb. 10, 2020, in the Korean Intellectual Property Office, the disclosure of which is incorporated by reference herein in its entirety.

BACKGROUND

1. Field

The disclosure relates to a hinge assembly and a refrigerator comprising the same. More particularly, the disclosure relates to a hinge assembly capable of height adjustment of a refrigerator door and a refrigerator comprising the same.

2. Description of Related Art

In general, a refrigerator is a home appliance which includes a storage compartment storing food products and a cooling air supplying device supplying cold air to the storage compartment, and is capable of storing food products freshly.

In this case, in order for the cold air in the storage compartment to not exit to the outside while taking out food products from within, the refrigerator may include a door which opens and closes the storage compartment.

In the case of refrigerators according to the related art which include several doors, because the heights of the doors are different in the manufacturing process of the refrigerator, the overall exterior of the refrigerator is undesirable, and there is the problem of returns by users occurring as a result thereof.

To solve this problem, there has been a method of adjusting to top and bottom step of the refrigerator door by additionally assembling a step adjusting ring having different thickness from one another to the part the refrigerator door is seated in the hinge according to the related art.

However, this step requires additional components such as a step adjusting ring, and there is the problem of having to reassemble after disassembling the refrigerator door from the hinge when adjusting the top and bottom step of the refrigerator door.

SUMMARY

According to an embodiment, a hinge assembly connecting a door of a refrigerator with a main body of a refrigerator includes a bracket configured so that a one surface is arranged at a lower part of the door, a shaft located on the bracket and configured to be a rotational shaft of the door, and a support member rotatably arranged inserted to the shaft, and configured to support the door, and a height of a support surface supporting the door is changed according to the support member rotating based on the shaft.

In this case, at least one from among the support member or the bracket may include a step adjusting member configured to vary a height of the support surface according to a rotation of the support member.

In this case, the step adjusting member may include a first step adjusting member included in the support member and a second step adjusting member included in the bracket and configured to couple with the first step adjusting member.

In this case, the first step adjusting member may include at least one coupling part, and the second step adjusting member may include a plurality of coupling grooves having a step, and the coupling part may couple with at least one from among the plurality of coupling grooves.

In this case, the plurality of coupling grooves may include a first coupling groove, a second coupling groove, and a third coupling groove, and the first to third coupling grooves may each form a step with each other.

In this case, the coupling part may include a first coupling part having a height corresponding to the first coupling groove and a second coupling part having a height corresponding to the second coupling groove, and based on the first coupling part being coupled to the first coupling groove, the second coupling part may be coupled to the second coupling groove, and based on the first coupling part being coupled to the second coupling groove, the second coupling part may be coupled to the third coupling groove.

Meanwhile, a step of the first and second coupling grooves may be 1 mm, and a step of the second and third coupling grooves may be 1 mm.

Meanwhile, the support member may include a circular area formed around the shaft and a protrusion area protrudingly formed from a one side of the circular area.

In this case, the bracket may include a plurality of fixing grooves, and the protrusion area may include a fixing protrusion which is inserted to at least one from among the plurality of fixing groove at a lower part.

In this case, the fixing protrusion may be inserted to one from among the plurality of fixing grooves according to a height of the support surface.

In this case, the plurality of fixing grooves may include a first fixing groove, a second fixing groove, and a third fixing groove, and the plurality of fixing grooves may each form a step with each other.

Meanwhile, the support member may be comprised of a polyoxymethylene (POM) material.

Meanwhile, the bracket may include a vertical area configured to couple to the main body of the refrigerator and a horizontal area configured to connect with a lower part of the support member.

Meanwhile, a thickness of the protrusion area may be 0.5 to 1.5 mm.

Meanwhile, a height of the fixing protrusion may be 2 to 8 mm.

According to an embodiment, a refrigerator includes a main body having a storage compartment, at least one door configured to open and close the storage compartment, and a hinge assembly configured to connect the door to the main body, and the hinge assembly includes a bracket coupled to a one surface of the main body, and configured so that a one surface is arranged at a lower part of the door, a shaft located on the bracket, and configured to be a rotational shaft of the door, and a support member rotatably arranged inserted to the shaft, and configured to support the door, and the support member is configured so that a height of a support surface supporting the door is changed according to being rotated based on the shaft.

In this case, the refrigerator may include a plurality of doors, and a plurality of hinge assemblies connecting each of the plurality of doors to the main body.

Meanwhile, at least one from among the support member or the bracket may include a step adjusting member configured to vary a height of the support surface according to a rotation of the support member.

In this case, the step adjusting member may include a first step adjusting member included in the support member and a second step adjusting member included in the bracket and configured to couple with the first step adjusting member.

In this case, the first step adjusting member may include at least one coupling part, and the second step adjusting member may include a plurality of coupling grooves having a step, and the coupling part may couple with at least one from among the plurality of coupling grooves.

BRIEF DESCRIPTION OF THE DRAWINGS

The above and other aspects, features and advantages of certain embodiments of the present disclosure will be more apparent from the following detailed description, taken in conjunction with the accompanying drawings, in which.

DETAILED DESCRIPTION

Figure 1:
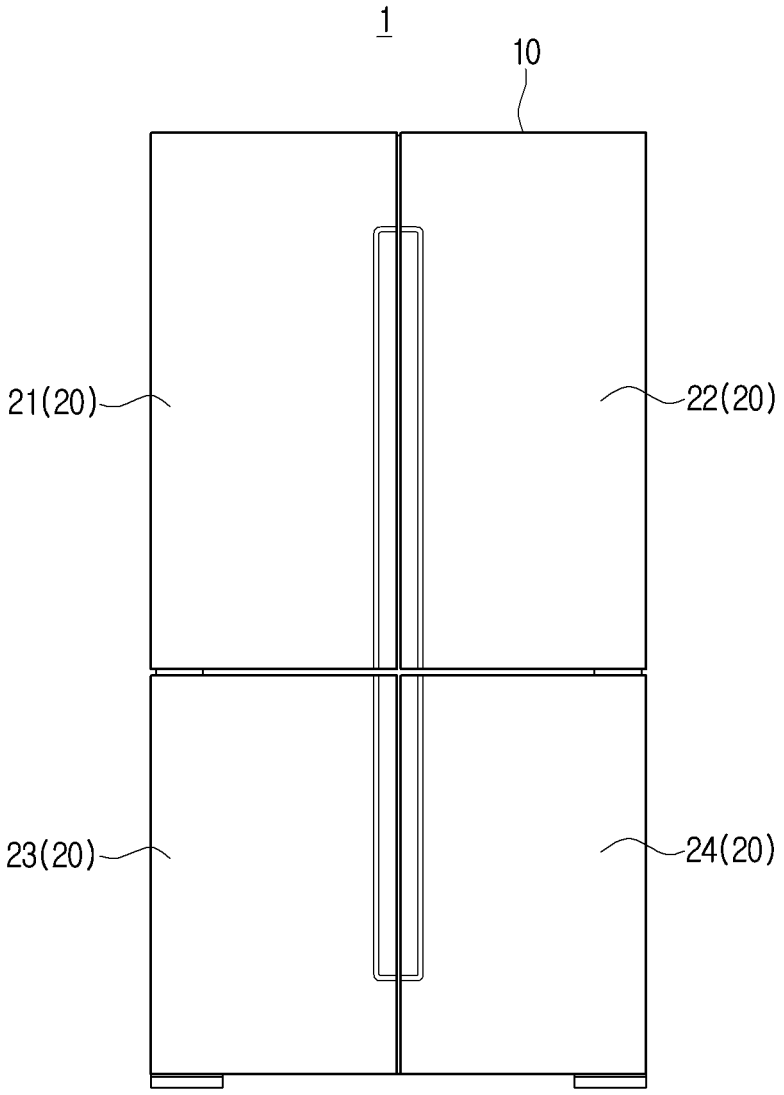
FIG. 1 is a front view illustrating schematically a refrigerator according to an embodiment.

Embodiments described herein are provided as example embodiments to assist in the understanding of the disclosure, and it is to be understood that the disclosure may be variously modified and realized, differently from the embodiments described herein. However, in describing the disclosure below, in case it is determined that detailed description of related known technologies may unnecessarily confuse the gist of the disclosure, the detailed description and the detailed drawing will be omitted. In addition, the accompanying drawings may not be illustrated according to the actual scale and the dimension of some elements may be exaggeratedly illustrated to assist in the understanding of the disclosure.

The terms used in the embodiments of the disclosure are general terms identified in consideration of the functions in the disclosure. However, these terms may vary depending on intention, legal or technical interpretation, emergence of new technologies, and the like of those skilled in the related art. Also, there may be some terms arbitrarily identified by an applicant. These terms may be construed by the meanings defined in the disclosure, or based on the overall content of the disclosure and the technological common sense of those skilled in the art if there are no specific definition of the term described herein.

In describing the disclosure, the order of each stage is to be understood as non-limiting unless the order of each stage needs to be performed such that a preceding stage must be performed logically and temporally prior to a following stage. That is, except for exceptional cases as described above, even if a process described as the following stage is performed preceding a process described as the preceding stage, it does not influence the nature of the disclosure and the scope of protection should also be defined regardless of the order of the stages.

In the disclosure, expressions such as "comprise," "may comprise," "include" or "may include" are used herein to designate a presence of a corresponding characteristic (e.g., elements such as a number, a step, an operation, a component, or the like), and not to preclude a presence or a possibility of additional characteristics.

Terms such as "first," "second," or the like may be used to describe various elements, but the elements are not limited by the terms. The terms may be used only to distinguish one element from another. For example, a first element may be designated as a second element without exceeding the scope of protection of the disclosure, and likewise the second element may be designated as the first element.

In addition, terms such as 'front surface,' 'rear surface,' 'top surface,' 'bottom surface,' 'side surface,' 'left side,' 'right side,' 'upper part,' 'lower part,' and the like used in the disclosure may be defined based on the drawings, and forms and locations of each element are not limited by these terms.

Further, because elements necessary in describing each embodiment of the disclosure are described in the disclosure, the embodiments are not limited thereto. Accordingly, some elements may be modified or omitted, and other elements may be added. In addition, the elements may be distributed to devices independent from one another and arranged.

Aspects of the disclosure are to address at least the above-mentioned problems and/or disadvantages and to provide at least the advantages described below. Accordingly, an aspect of the disclosure is to provide a hinge assembly capable of adjusting a top and bottom height of a refrigerator door without additional components and a refrigerator comprising the same.

Furthermore, although one or more embodiments of the disclosure have been described in detail with reference to the accompanied drawings and the descriptions of the accompanied drawings, the disclosure is not limited to the embodiments.

The disclosure will be described in greater detail below with reference to FIGS. 1 to 12.

Although a refrigerator including a hinge assembly according to an embodiment of the disclosure is described below as an example, the embodiment is not limited thereto, and the hinge assembly according to an embodiment of the disclosure may be applied to various devices including a door. For example, the hinge assembly according to an embodiment of the disclosure may be applied to a washer or the like including a door, and may be applied to not only electronic products, but also various furniture or the like which includes a door.

FIG. 1 is a front view illustrating schematically a refrigerator 1 according to an embodiment of the disclosure.

The refrigerator 1 may be a device which provides cold air generated by a cooling cycle to a storage compartment so that freshness of various food products may be maintained for a long period.

Referring to FIG. 1, the refrigerator 1 according to an embodiment of the disclosure may include a main body 10, and doors 21, 22, 23 and 24 capable of opening and closing a storage compartment (not shown).

Although four doors 20 are illustrated in FIG. 1, the number of the doors 20 is not limited thereto, and the location and shape of the doors 20 may be variously arranged. The refrigerator 1 may be a French door type, a side-by-side type, or the like according to the arrangement of the doors 20 and the storage compartment.

Although not illustrated in FIG. 1, the refrigerator 1 may include a storage compartment (not shown) capable of storing a variety of food products in a cooled or frozen state. The storage compartment may be divided into a refrigeration compartment in which food products are stored in a cooled state at above zero temperature and a freezer compartment in which a variety of food products are stored at below zero temperature.

In addition, the refrigerator 1 may be provided with components such as a compressor, a condenser, an expander, and an evaporator to comprise a cooling cycle.

The door 20 may be rotatably connected to the main body 10 by a hinge assembly 100. The detailed described on the hinge assembly 100 will be described below.

Figure 2:
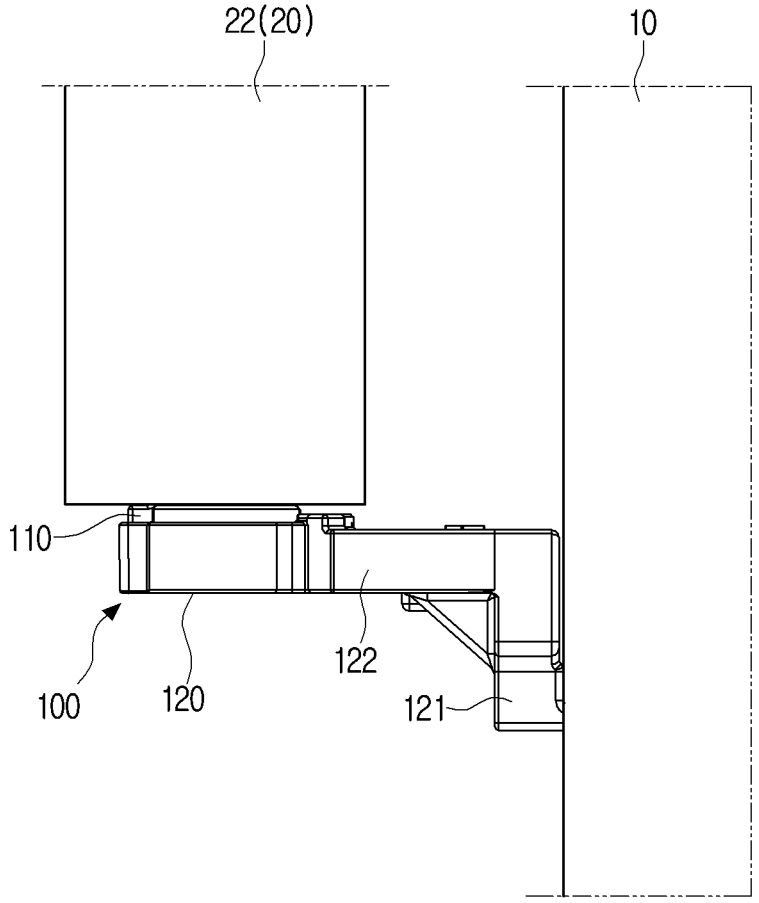
FIG. 2 is an enlarged side view illustrating a side surface of an area in which a hinge assembly of a refrigerator is located according to an embodiment.

FIG. 2 is an enlarged side view illustrating a side surface of an area in which a hinge assembly 100 of a refrigerator 1 is located according to an embodiment of the disclosure.

Referring to FIG. 2, the hinge assembly 100 may connect a refrigerator door 22 with a refrigerator main body 10. Although the hinge assembly 100 has been illustrated as supporting an upper right door 22 in FIG. 2, the embodiment is not limited thereto, and the hinge assembly 100 may be arranged at a lower part of all doors 21, 22, 23 and 24 of the refrigerator 1, or arranged only at a portion of the doors 20.

The hinge assembly 100 may include a support member 110, a bracket 120, and a shaft (not shown).

The bracket 120 may include a vertical area 121 and a horizontal area 122. The vertical area 121 may be configured such that one surface is coupled to the main body 10. The horizontal area 122 may be arranged at the lower part the door 20 and support the door 20. The detailed description on the bracket 120 will be described below.

The shaft is located on the bracket 120, and may be a rotational shaft of the door 20. Accordingly, the door 20 may be rotatably coupled to the main body 10.

The support member 110 may be inserted to the shaft and arranged to be rotatable. In this case, the support member 110 may be in contact with the door 20 by being arranged at the lower part of the door 20 and support the door 20.

In addition, the support member 110 may adjust, by rotating and changing the height of a support surface supporting the door, the height of the door 20. The operation of support member 110 adjusting the height of the door 20 will be described in detail below.

Figure 3:
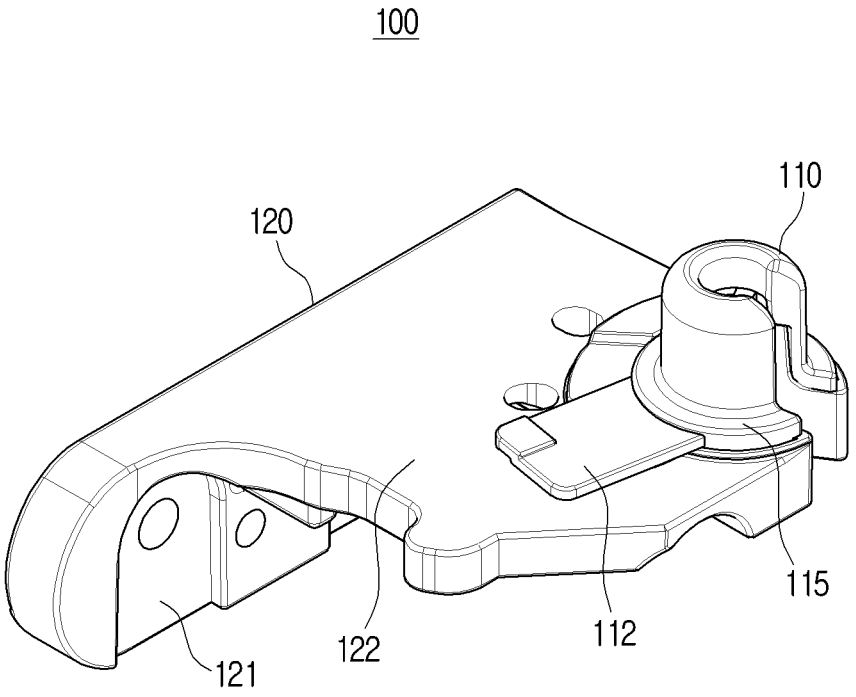
FIG. 3 is a perspective view illustrating a hinge assembly according to an embodiment.
Figure 4:
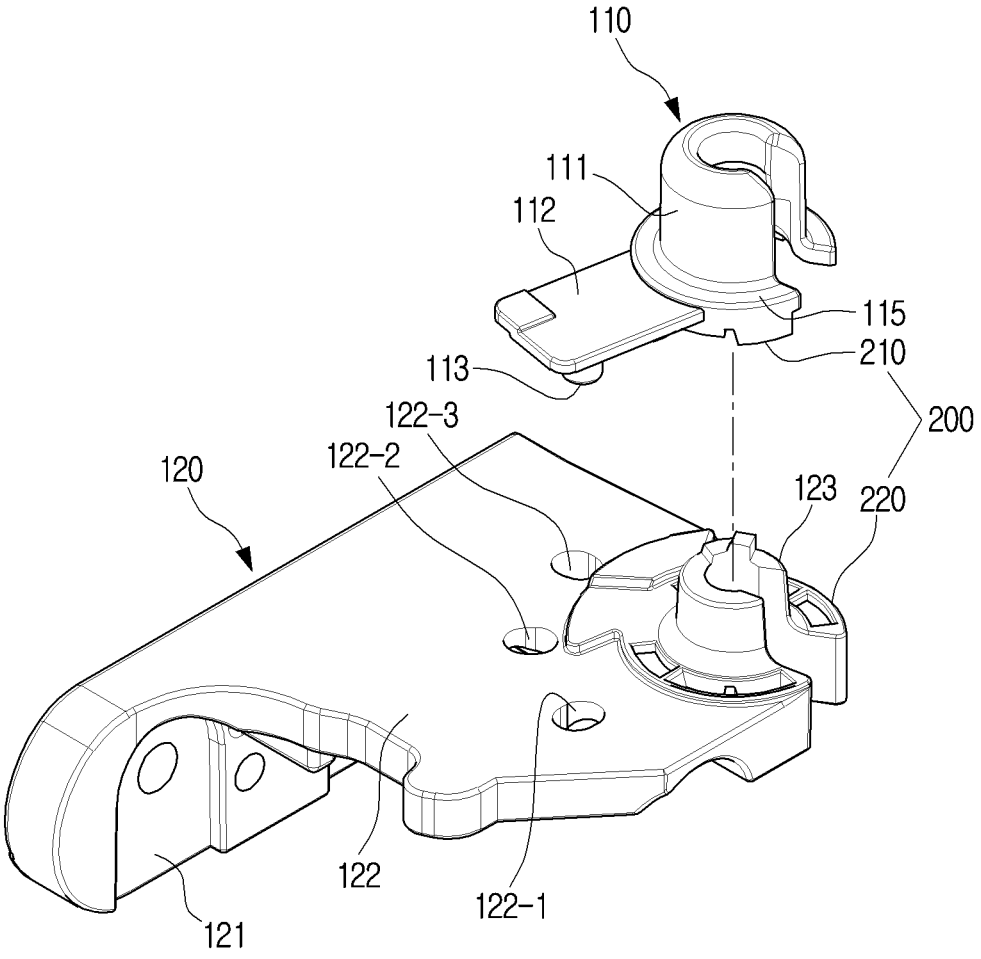
FIG. 4 is an exploded perspective view of the hinge assembly of FIG. 3.

FIG. 3 is a perspective view illustrating a hinge assembly 100 according to an embodiment of the disclosure, and FIG. 4 is an exploded perspective view of the hinge assembly of FIG. 3.

Referring to FIGS. 3 and 4, the hinge assembly 100 may include the support member 110 and the bracket 120.

The support member 110 may be arranged at an upper part of the horizontal area 122 of the bracket 120. In this case, the support member 110 may be coupled and/or fixed with the bracket 120.

Referring to FIG. 4, the support member 110 may include a circular area 111 formed around the shaft, a protrusion area 112 protrudingly formed from a one side of the circular area 111, and a fixing protrusion 113 formed at a lower end of the protrusion area 112. The detailed description on a structure of the support member 110 will be described in FIG. 5.

Referring to FIG. 4, a plurality of fixing grooves 122-1, 122-2 and 122-3 and a shaft support area 123 formed around the shaft may be formed to the horizontal area 122 of the bracket 120. The detailed description on a structure of the bracket 120 will be described in FIG. 6.

The support member 110 may include a step adjusting member (an adjusting member) 200 which varies the height of the support surface 115 that supports the door according to rotation. Accordingly, the support member 110 and the bracket 120 may be coupled without a separate additional component.

The step adjusting member 200 may be a configuration included in the support member 110, but is not limited thereto, and may be a configuration included in the bracket 120, may be provided in at least one from among the support member 110 or the bracket 120, and may be provided in both the support member 110 and the bracket 120.

For example, the step adjusting member 200 may include a first step adjusting member 210 included in the support member 110 and a second step adjusting member 220 included in the bracket 120. In this case, the first step adjusting member 210 and the second step adjusting member 220 may couple and connect the support member 110 with the bracket 120.

The first step adjusting member 210 and the second step adjusting member 220 may couple in different forms from each other according to the rotation of the support member 110, and may vary the height of the support surface 115.

In addition, the support member 110 and the bracket 120 may be fixed by structures such as the structure of the step adjusting member 200 and the fixing protrusion 113 of the support member 110, and the fixing grooves 122-1, 122-2 and 122-3 of the bracket 120.

The detailed description on the step adjusting of the support member 110 and the structure which couples and fixes the support member 110 to the bracket 120 will be described below in FIGS. 5 to 6.

Meanwhile, although not illustrated in FIGS. 3 and 4, the hinge assembly 100 may include a shaft which connects to the door 20.

The shaft may penetrate the circular area 111 of the support member 110 and an empty space at the center of the shaft support area 123 of the bracket 120 and may be connected to the support member 110 and the bracket 120. Accordingly, using the shaft as a rotational shaft, the door 20 may be opened and closed by rotating.

The support member 110 and the structure of each of the brackets 120 will be described in detail below with reference to FIGS. 5 to 6.

Figure 5:
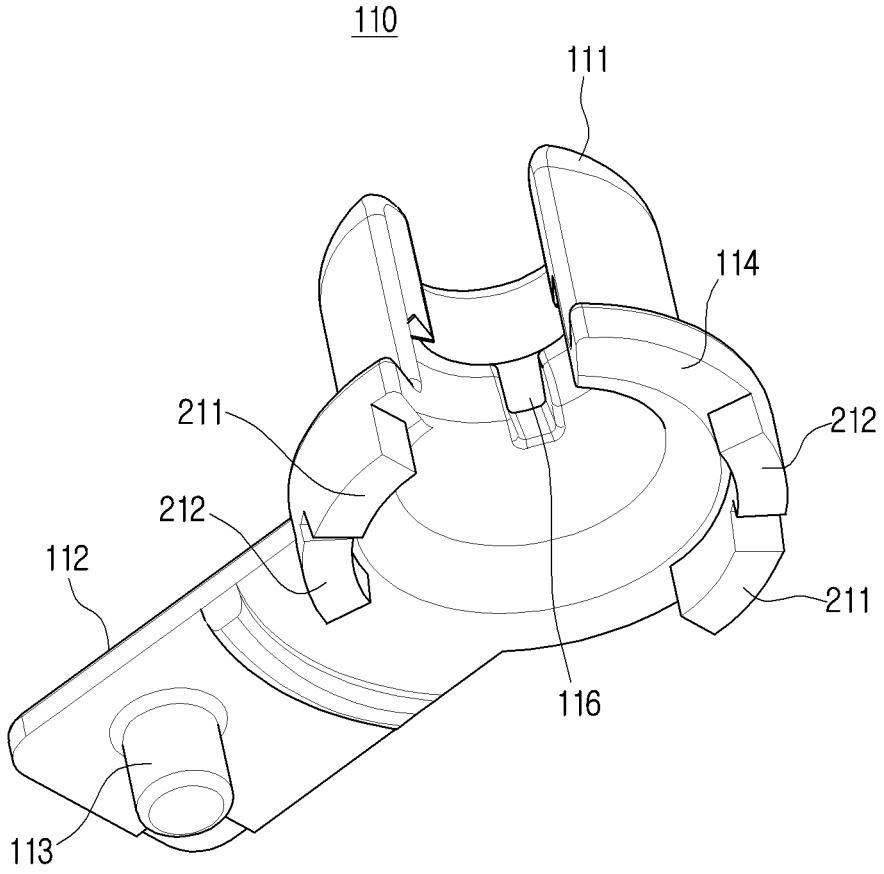
FIG. 5 is a lower perspective view of a support member according to an embodiment.

FIG. 5 is a lower perspective view of a support member 110 according to an embodiment of the disclosure.

Referring to FIG. 5, the support member 110 may include the circular area 111 formed around the shaft and the protrusion area 112 protrudingly formed from one side of the circular area 111.

As shown in FIG. 5, a supporting protrusion 116 is supported by an upper surface of the shaft support area 123 (FIG. 4) when the support member 110 is arranged on the bracket 120.

The first step adjusting member 210 may be provided on a bottom surface 114 of the support member 110. In this case, the first step adjusting member 210 may include at least one coupling parts 211 and 212 protrudingly formed from the bottom surface 114 of the support member.

Although FIG. 5 illustrates two first coupling parts 211 and two second coupling parts 212, the number of coupling parts are not limited thereto, and the coupling part may be one or may be three or more.

For convenience of description, the first coupling part 211 and the second coupling part 212 being present has been described as an example below.

The first coupling part 211 and the second coupling part 212 may form a step. For example, the height of the first coupling part 211 may form a step which is 1 mm higher than the height of the second coupling part 212.

The coupling parts 211 and 212 may vary the height of the support surface 115 by coupling with at least one from among the plurality of coupling grooves of the second step adjusting member 220 according to the rotation of the support member 110. The detailed description on the coupling relationship of the coupling parts 211 and 212 with the coupling groove, and the height adjustment of the support surface 115 will be described below.

The protrusion area 112 may be protrudingly formed from the one side surface of the circular area 111. Based on the door 20 being seated on the support member 110, the circular area 111 may not come into the view of a user because most of the area is covered by the door 20. On the other hand, because the protrusion area 112 is protrudingly formed from the circular area 111, the area may be visible to the user without having to separate the door 20 from the support member 110.

In addition, because the protrusion area 112 is not covered by the door 20, the support member 110 may be separated from a fastening structure and easily rotated without the user having to fully separate the door 20 from the support member 110.

The thickness of the protrusion area 112 may be 0.5 to 1.5 mm. Because the protrusion area 112 has a relatively thin thickness, there may be elasticity. Accordingly, the user may easily separate the protrusion area 112 from the top surface of the bracket 120.

The support member 110 may include the fixing protrusion 113 at the bottom surface of the protrusion area 112.

The fixing protrusion 113 may be inserted to at least one from among the plurality of fixing grooves 122-1, 122-2 and 122-3 provided to the horizontal area 122 of the bracket 120, and fix the support member 110 on the bracket 120.

The height of the fixing protrusion 113 may correspond to the depth of the fixing groove. For example, the height of the fixing protrusion 113 may be 2 to 8 mm. The detailed description on the fastening structure of the fixing protrusion 113 with the fixing grooves 122-1, 122-2 and 122-3 will be described below in FIG. 6.

The support member 110 may be comprised of a material with elasticity, and accordingly friction between the door 20 and the bracket 120 may be reduced. For example, the support member 110 may be comprised of a polyoxymethylene (POM) material. Accordingly, the door 20 may perform a smooth rotational operation, and wearing of the part to which the door 20 and the bracket 120 is connected may be prevented.

Figure 6:
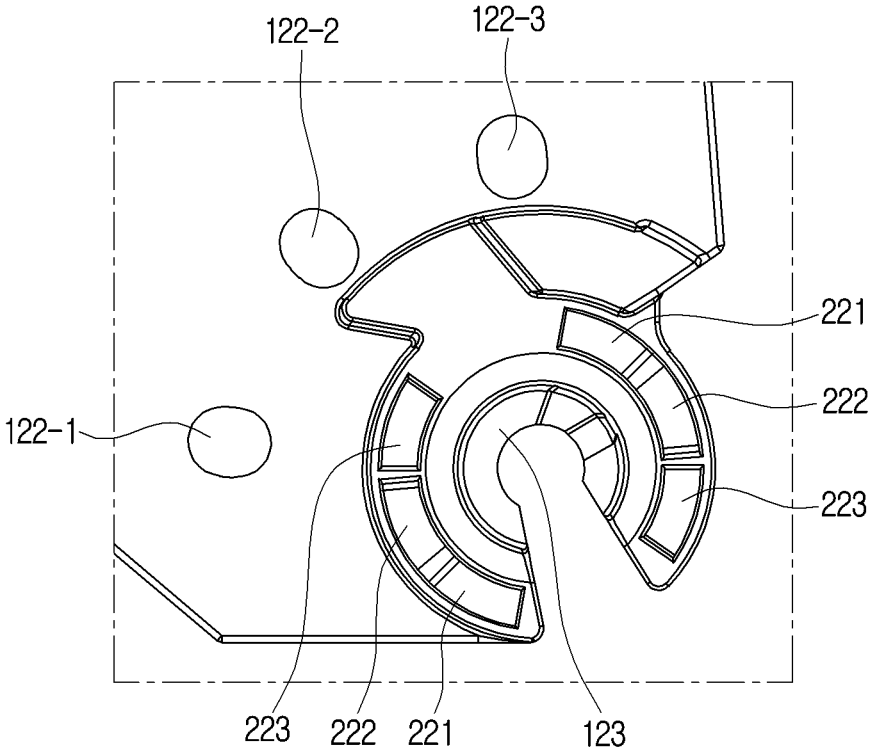
FIG. 6 is an enlarged plan view illustrating an area in which a second step adjusting member of a bracket is located according to an embodiment.

FIG. 6 is an enlarged plan view illustrating an area in which a second step adjusting member 220 of a bracket 120 is located according to an embodiment of the disclosure.

Referring to FIG. 6, the second step adjusting member 220 may be provided to the horizontal area 122 of the bracket 120. In this case, the second step adjusting member 220 may include the plurality of coupling grooves 221, 222 and 223 which each forms a step.

Although FIG. 6 illustrates two first coupling grooves 221, two second coupling grooves 222 and two third coupling grooves 223, the number of the coupling grooves are not limited thereto, and the coupling groove may be two or may be three or more. For convenience of description, the first coupling groove 221, the second coupling groove 222, and the third coupling groove 223 being present has been described as an example below.

The first to third coupling grooves 221, 222 and 223 may each form a step. For example, the step of the first and second coupling grooves may be 1 mm, and the step of the second and third coupling grooves may be 1 mm.

The first step adjusting member 210 of the support member 110 and the second step adjusting member 220 of the bracket 120 may couple and connect the support member 110 and the bracket 120. For example, the coupling parts 211 and 212 of the first step adjusting member 210 may couple with at least one from among the plurality of coupling grooves 221, 222 and 223 of the second step adjusting member 220.

In this case, the height of the coupling parts 211 and 212 may correspond to the depth of any one from among the plurality of coupling grooves 221, 222 and 223. For example, the first coupling part 211 may have a height corresponding to the first coupling groove 221, and the second coupling part 212 may have a height corresponding to the second coupling groove 222.

The arrangement in which the coupling parts 211 and 212 and the coupling grooves 221, 222 and 223 are coupled may be varied based on the arrangement according to the rotation of the support member 110. For example, the second coupling part 212 may be coupled to the second coupling groove 222 based on the first coupling part 211 being coupled to the second coupling groove 222, and the second coupling part 212 may be coupled to the third coupling groove 223 based on first coupling part 211 being coupled to the second coupling groove 222.

Accordingly, the coupling parts 211 and 212 and the coupling grooves 221, 222 and 223 may be coupled in different forms from one another according to the stage, and vary the height of the support surface 115. The detailed description on the height variance of the support surface 115 according to the coupling form of the coupling parts 211 and 212 and the coupling grooves 221, 222 and 223 will be described below in FIGS. 7 to 12.

Referring to FIG. 6, the bracket 120 may include the plurality of fixing grooves 122-1, 122-2 and 122-3 in the horizontal area 122.

The fixing protrusion 113 included in the support member 110 may be inserted to at least one from among the plurality of fixing grooves 122-1, 122-2 and 122-3.

In this case, the fixing protrusion 113 may be inserted to any one from among the plurality of fixing grooves 122-1, 122-2 and 122-3 according to the coupling stage of the support member 110 and the bracket 120. The detailed description on the fastening relationship of the fixing protrusion 113 with the plurality of fixing grooves 122-1, 122-2 and 122-3 will be described below in FIGS. 7 to 12.

The method of adjusting the top and bottom step of the hinge assembly 100 according to an embodiment of the disclosure will be described below with reference to FIGS. 7 to 12.

Although the hinge assembly 100 capable of adjusting the top and bottom step in three stages has been illustrated in FIGS. 7 to 12, the number of stages for adjusting the top and bottom step of the hinge assembly 100 is not limited thereto, and may be in two stages or may be in four or more stages.

For convenience of description, the hinge assembly 100 being capable of adjusting the top and bottom step in three stages has been described as an example below.

Figure 7:
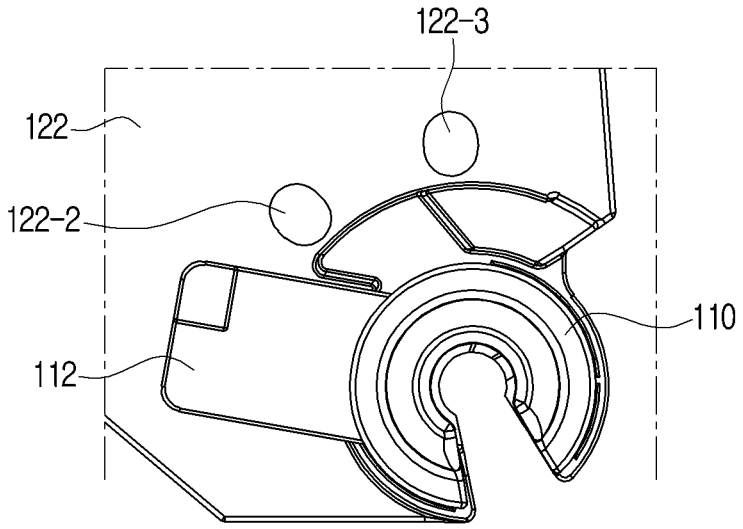
FIG. 7 is a plan view illustrating an adjusting of a top and bottom step of a hinge assembly according to an embodiment.
Figure 8:
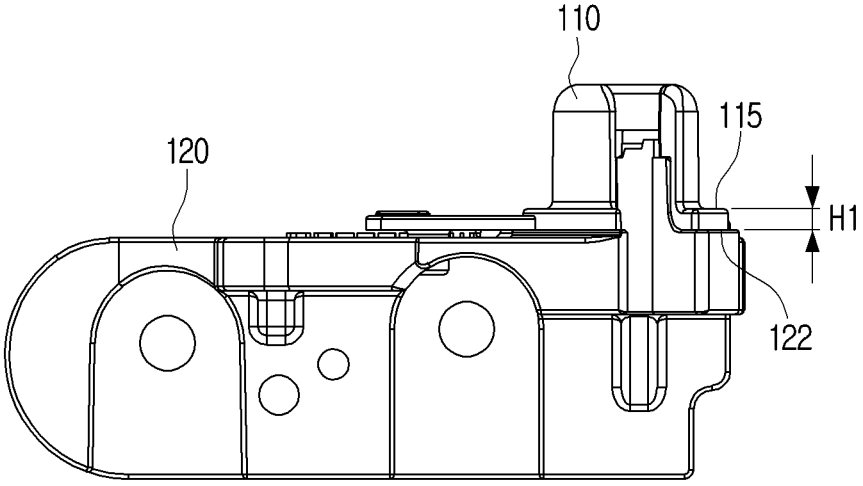
FIG. 8 is a side view of the hinge assembly of FIG. 7 viewed from a side surface.

FIGS. 7 to 8 are views illustrating the top and bottom step adjusting stage of the hinge assembly 100 being in a first step state.

FIG. 7 is a plan view of a stage of adjusting a top and bottom step of the hinge assembly 100 being in a first stage state, and FIG. 8 is a side view of the hinge assembly 100 of FIG. 7 viewed from a side surface.

Based on the stage of adjusting the top and bottom step of the hinge assembly 100 being in the first stage state, the first coupling part 211 of the support member 110 may be coupled to the first coupling groove 122-1 of the bracket 120, and the second coupling part 212 may be coupled to the second coupling groove 122-2.

In this case, the first and second coupling parts 211 and 212 may each have a height corresponding to the first and second coupling grooves 122-1 and 122-2. That is, the step between the first and second coupling parts 211 and 212 may be the same as the step between the first and second coupling grooves 122-1 and 122-2. Accordingly, the bottom surface of each of the coupling parts may surface contact with the top surface of each of the coupling grooves.

Referring to FIG. 8, a first stage step H1 may be formed in between the support surface 115 of the support member 110 and the top surface of the horizontal area 122 of the bracket 120. That is, the bottom surface of the door 20 which is supported by the support surface 115 of the support member 110 and the top surface of the horizontal area 122 of the bracket 120 may have a step by H1.

Referring to FIG. 7, the protrusion area 112 of the support member 110 may be arranged at a location corresponding to the first coupling groove 122-1 of the bracket 120, and the fixing protrusion 113 may be inserted and coupled to the first coupling groove 122-1. Accordingly, the support member 110 may be fixed after being mounted on the bracket 120, and prevent the rotation and separation of the support member 110.

In addition, based on the protrusion area 112 being protrudingly formed from the circular area 111, it may be visible to the user even when the door 20 is seated on the support member 110. Accordingly, based on the user being able to confirm the arrangement of the protrusion area 112 without separating the door 20 from the support member 110, the stage of adjusting the top and bottom step of the current hinge assembly 100 being arranged at which stage may be confirmed.

Figure 9:
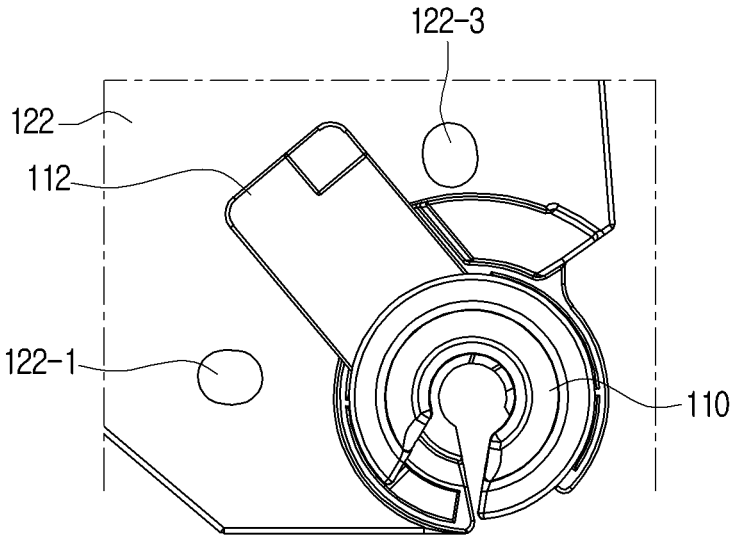
FIG. 9 is a plan view illustrating an adjusting of a top and bottom step of a hinge assembly according to an embodiment.
Figure 10:
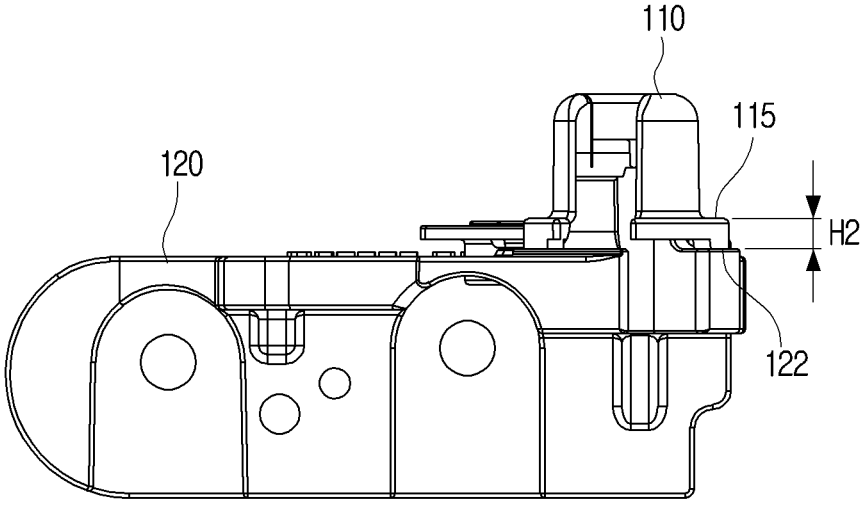
FIG. 10 is a side view of the hinge assembly of FIG. 9 viewed from a side surface.

FIGS. 9 to 10 are views illustrating a stage of adjusting a top and bottom step of the hinge assembly 100 being in a second stage state.

FIG. 9 is a plan view illustrating a stage of adjusting a top and bottom step of the hinge assembly 100 being in a second stage state, and FIG. 10 is a side view of the hinge assembly 100 of FIG. 9 viewed from a side surface.

Based on the stage of adjusting the top and bottom step of the hinge assembly 100 being in the second stage state, the first coupling part 211 of the support member 110 may be coupled to the second coupling groove 122-2 of the bracket 120, and the second coupling part 212 may be coupled to the third coupling groove 122-3.

In this case, the step between the first and second coupling parts 211 and 212 may be the same as the step between the second and third coupling grooves 122-2 and 122-3. Accordingly, the bottom surface of each of the coupling parts may surface contact with the top surface of each of the coupling grooves.

Referring to FIG. 10, a second stage step H2 may be formed in between the support surface 115 of the support member 110 and the top surface of the horizontal area 122 of the bracket 120. That is, the bottom surface of the door 20 which is supported by the support surface 115 of the support member 110 and the top surface of the horizontal area 122 of the bracket 120 may have a step by H2.

In this case, based on the first and second coupling parts 211 and 212 being coupled to the second and third coupling grooves 122-2 and 122-3 each of which have a depth shallower than the first and second coupling grooves 122-1 and 122-2 of the above-described first stage in FIGS. 7 and 8, the height of the support surface 115 of the support member 110 may increase by the step between the coupling grooves. That is, H2 may have a value greater than H1 by the step of the coupling groove.

Accordingly, because the height from the bracket 120 of the door 20 which is supported by the support surface 115 may also increase, the height of the vertical direction of the door 20 may be adjusted.

Figure 11:
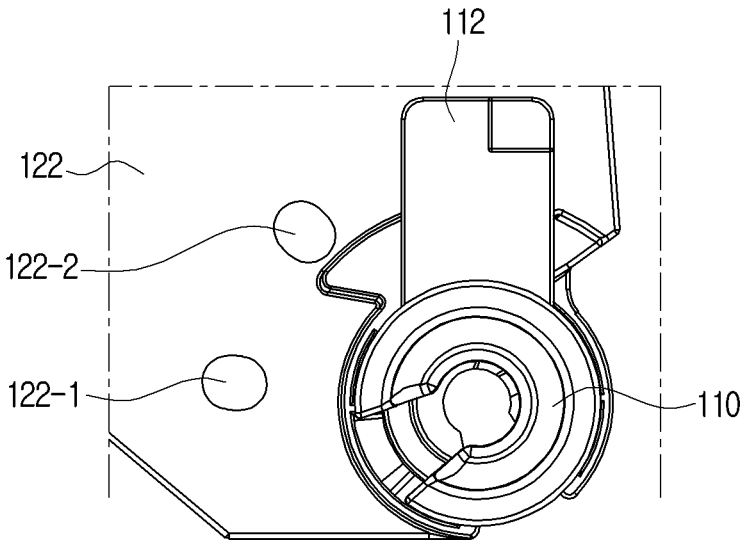
FIG. 11 is a plan view illustrating an adjusting of a top and bottom step of a hinge assembly according to an embodiment.
Figure 12:
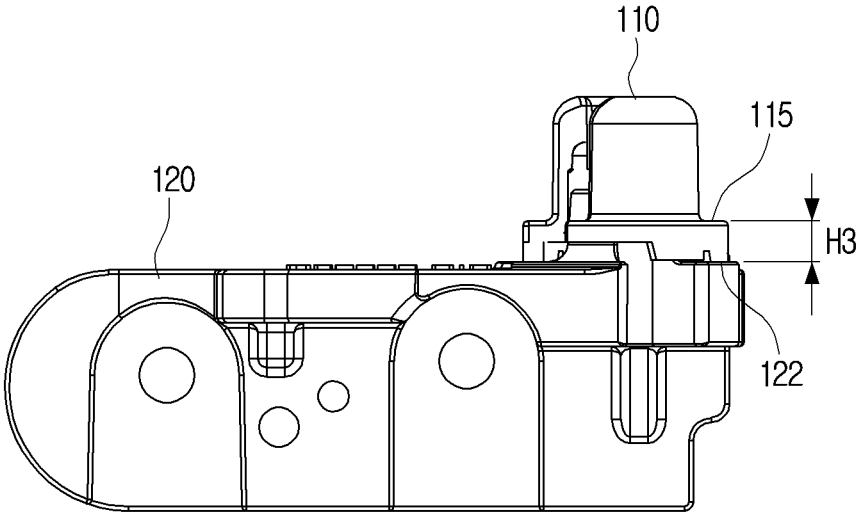
FIG. 12 is a side view of the hinge assembly of FIG. 11 viewed from a side surface.

FIGS. 11 to 12 are views illustrating a stage of adjusting a top and bottom step of the hinge assembly 100 being in a third stage state.

FIG. 11 is a plan view illustrating a stage of adjusting a top and bottom step of the hinge assembly 100 being in a third stage state, and FIG. 12 is a side view of the hinge assembly 100 of FIG. 11 viewed from a side surface.

Based on the stage of adjusting the top and bottom step of the hinge assembly 100 being in the third stage state, the first coupling part 211 of the support member 110 may be coupled to the third coupling groove 122-3 of the bracket 120.

In this case, the bottom surface of the first coupling part 211 may surface contact with the top surface of the third coupling groove 122-3.

Referring to FIG. 12, a third stage step H3 may be formed in between the support surface 115 of the support member 110 and the top surface of the horizontal area 122 of the bracket 120. That is, the bottom surface of the door 20 which is supported by the support surface 115 of the support member 110 and the top surface of the horizontal area 122 of the bracket 120 may have a step by H3.

In this case, based on the first coupling part 211 being coupled to the third coupling groove 122-3 which has a depth shallower than the second coupling groove 122-2 of the above-described second stage in FIG. 10, the height of the support surface 115 of the support member 110 may increase by the step between the coupling grooves. That is, H3 may have a value greater than H2 by the step of the coupling groove.

Accordingly, because the height of the support surface 115 may be changed per stage by rotating the support member 110, the height of the vertical direction of the door 20 may be adjusted per stage.

While the disclosure has been illustrated and described with reference to various example embodiments thereof, the disclosure is not limited to the specific embodiments described, and it will be understood by those skilled in the art that various changes in form and details may be made therein without departing from the spirit and scope of the disclosure.

What is claimed is:

1. A hinge assembly to connect a door of a refrigerator with a main body of the refrigerator, comprising:

a bracket configured so that a surface of the hinge assembly is arranged at a lower part of the door;

a shaft configured to be coupleable to the bracket and which is configured to be a rotational shaft of the door; and a support member rotatably arranged around the shaft while the shaft is coupled to the door, the support member configured to be coupleable to and decoupleable from the bracket by a protrusion formed to protrude from the support member in a direction perpendicular to the shaft while the shaft is coupled to the door, wherein a height of a support surface supporting the door is changeable according to a rotation of the support member about the shaft while the support member is uncoupled from the bracket, wherein the bracket comprises a plurality of fixing grooves and the protrusion comprises a fixing protrusion which is inserted to at least one fixing groove from among the plurality of fixing grooves at a lower part to couple the supporting member to the bracket.

2. The hinge assembly of claim 1, wherein at least one from among the support member or the bracket comprises:

an adjusting member configured to vary the height of the support surface according to the rotation of the support member.

3. The hinge assembly of claim 2, wherein the adjusting member comprises:

a first adjusting member comprised in the support member; and a second adjusting member comprised in the bracket and configured to couple with the first adjusting member.

4. The hinge assembly of claim 3, wherein the first adjusting member comprises at least one coupling part, and the second adjusting member comprises a plurality of coupling grooves arranged to be stepped inward, wherein the at least one coupling part couples with at least one groove from among the plurality of coupling grooves.

5. The hinge assembly of claim 4, wherein the plurality of coupling grooves comprise:

a first coupling groove;

a second coupling groove; and a third coupling groove, wherein the first coupling groove, the second coupling groove and the third coupling groove are formed to be stepped from each other.

6. The hinge assembly of claim 5, wherein the at least one coupling part comprises:

a first coupling part with a height corresponding to the first coupling groove; and a second coupling part with a height corresponding to the second coupling groove, wherein, based on the first coupling part being coupled to the first coupling groove, the second coupling part is coupled to the second coupling groove, and based on the first coupling part being coupled to the second coupling groove, the second coupling part is coupled to the third coupling groove.

7. The hinge assembly of claim 5, wherein the first coupling groove and the second coupling groove are stepped inward by 1 mm relative to each other, and the second coupling groove and the third coupling groove are stepped inward by 1 mm relative to each other.

8. The hinge assembly of claim 1, wherein the support member comprises:

a circular area formed around the shaft; and the protrusion is formed to protrude from one side of the circular area.

9. The hinge assembly of claim 8, wherein a thickness of the protrusion is 0.5 to 1.5 mm.

10. The hinge assembly of claim 1, wherein the fixing protrusion is inserted to one fixing groove from among the plurality of fixing grooves according to a height of the support surface.

11. The hinge assembly of claim 10, wherein the plurality of fixing grooves comprises:

a first fixing groove;

a second fixing groove; and a third fixing groove, wherein the first fixing groove, the second fixing groove and the third fixing groove are formed to be stepped from each other.

12. The hinge assembly of claim 1, wherein the support member is comprised of a polyoxymethylene (POM) material.

13. The hinge assembly of claim 1, wherein the bracket comprises:

a vertical area configured to couple to the main body of the refrigerator; and a horizontal area configured to connect with a lower part of the support member.

14. The hinge assembly of claim 1, wherein a height of the fixing protrusion is 2 to 8 mm.

15. A refrigerator, comprising:

a main body with a storage compartment;

at least one door configured to open and close the storage compartment; and a hinge assembly configured to connect the at least one door to the main body, wherein the hinge assembly comprises:

a bracket coupled to a surface of the main body, and configured so that the surface is arranged at a lower part of the at least one door;

a shaft configured to be coupleable to the bracket, and which is configured to be a rotational shaft of the at least one door; and a support member rotatably arranged around the shaft while the shaft is coupled to the at least one door, the support member configured to be coupleable to and decoupleable from the bracket by a protrusion formed to protrude from the support member in a direction perpendicular to the shaft while the shaft is coupled to the at least one door, wherein the support member is configured so that a height of a support surface supporting the at least one door is changeable according to being rotated about the shaft while the support member is uncoupled from the bracket wherein the bracket comprises a plurality of fixing grooves and the protrusion comprises a fixing protrusion which is inserted to at least one fixing groove from among the plurality of fixing grooves at a lower part to couple the supporting member to the bracket.

16. The refrigerator of claim 15, comprising:

a plurality of doors including the at least one door; and a plurality of hinge assemblies connecting each of the plurality of doors to the main body.

17. The refrigerator of claim 15, wherein at least one from among the support member or the bracket comprises an adjusting member configured to vary the height of the support surface according to a rotation of the support member.

18. The refrigerator of claim 17, wherein the adjusting member comprises:

a first adjusting member comprised in the support member; and a second adjusting member comprised in the bracket and configured to couple with the first adjusting member.

19. The refrigerator of claim 18, wherein the first adjusting member comprises at least one coupling part, and the second adjusting member comprises a plurality of coupling grooves arranged to be stepped inward, wherein the at least one coupling part couples with at least one groove from among the plurality of coupling grooves.

* * * * *